United States Patent [19]

Brechbuehler

[11] Patent Number: 4,796,851

[45] Date of Patent: Jan. 10, 1989

[54] REINFORCING ROD HOLDER FOR USE IN JOINING CAST CONCRETE WORK

[75] Inventor: Fritz Brechbuehler, Muensingen, Switzerland

[73] Assignee: Pebea, N.V., Curacao, Netherlands Antilles

[21] Appl. No.: 3,266

[22] Filed: Jan. 14, 1987

[30] Foreign Application Priority Data

Jan. 15, 1986 [EP] European Pat. Off. ..... 86810014.0
Mar. 24, 1986 [EP] European Pat. Off. ..... 86810139.5

[51] Int. Cl.[4] ..... E04B 1/41

[52] U.S. Cl. ..... 249/91; 52/378; 52/699; 52/712; 249/188; 249/210

[58] Field of Search ..... 52/98, 169.14, 333, 52/334, 309.15, 309.16, 378, 515, 587, 698, 699, 712; 249/83, 84, 91, 94, 97, 114, 188, 210

[56] References Cited

U.S. PATENT DOCUMENTS

| | | | |
|---|---|---|---|
| 4,010,586 | 3/1977 | Brechbuhler | 52/378 |
| 4,081,941 | 4/1978 | Van Ausdall | 52/727 |
| 4,325,533 | 4/1982 | Tiletschke et al. | 249/188 |
| 4,329,825 | 5/1982 | Zehtner | 52/698 |
| 4,338,757 | 7/1982 | Witschi et al. | 52/378 |
| 4,419,852 | 12/1983 | Dietrich | 52/378 |
| 4,468,907 | 9/1984 | Tiletschke et al. | 52/333 |
| 4,549,384 | 10/1985 | Brechbühler | 52/378 |
| 4,562,679 | 1/1986 | Pattiselanno | 52/378 |
| 4,594,830 | 6/1986 | Matz et al. | 52/378 |

FOREIGN PATENT DOCUMENTS

| | | | |
|---|---|---|---|
| 0079298 | 5/1983 | European Pat. Off. . | |
| 0165367 | 12/1985 | European Pat. Off. . | |
| 0188986 | 7/1986 | European Pat. Off. | 52/699 |
| 3306433 | 10/1983 | Fed. Rep. of Germany . | |

*Primary Examiner*—Jay H. Woo
*Assistant Examiner*—James C. Housel
*Attorney, Agent, or Firm*—Marks, Murase & White

[57] ABSTRACT

The reinforcing rod holder for use in joining cast concrete work has a body comprising a box-shaped portion and a cover portion which comprises a metal plate with a rough surface and faces the concrete wall which is to be erected, the cover portion being adapted to remain in the erected concrete wall. On its outer wall, the box has means to permit concrete to pass behind the cover portion when the holder is embedded in concrete in order to secure the cover portion. In addition, securing means are disposed on the box and on the cover portion in order to secure the cover portion on the box. The reinforcing rods extend through rod retainers, the upper portion of which protrude through an elongated opening in the metal plate and seal the plate. The box of the holder is preferably formed from plastics material and can be very easily and fully removed after the holder has been embedded in concrete, whereby the holder can be manufactured more economically than a holder which is manufactured partly or entirely from metal.

21 Claims, 5 Drawing Sheets

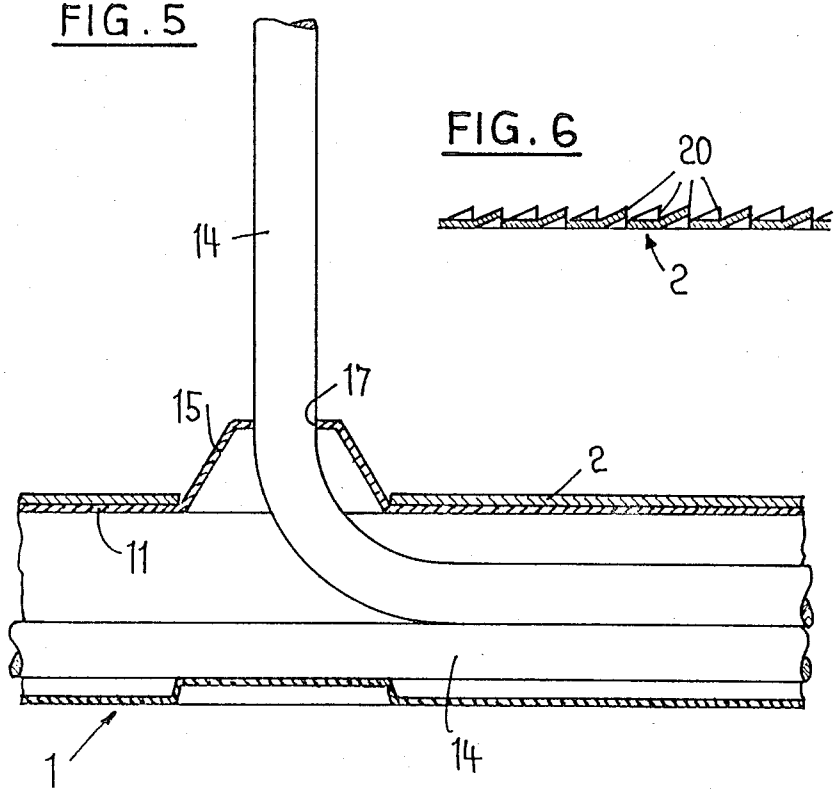
FIG. 6
FIG. 5
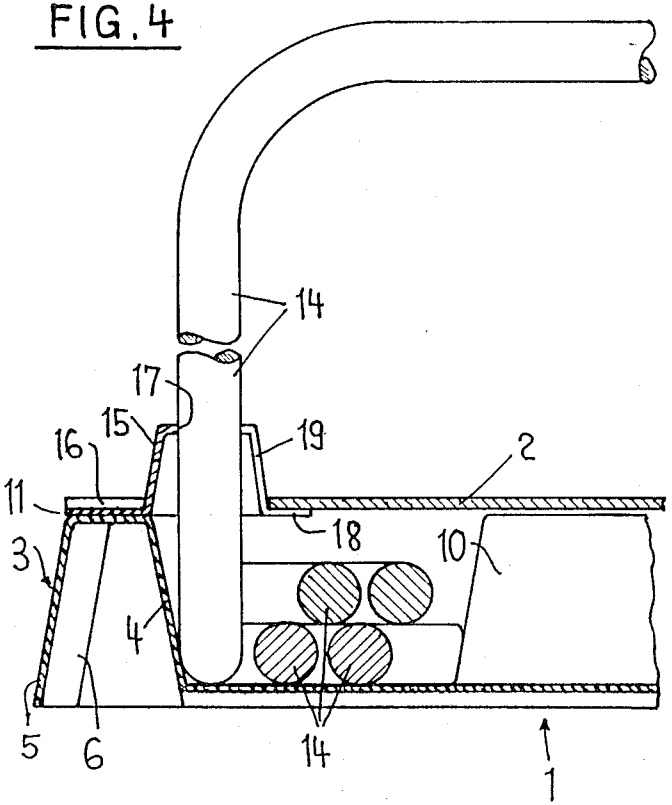
FIG. 4

REINFORCING ROD HOLDER FOR USE IN JOINING CAST CONCRETE WORK

BACKGROUND OF THE INVENTION

1. Field of the Invention

The present invention relates to a reinforcing rod holder for use in joining cast concrete work, comprising a hollow body for receiving the free, bent ends of the reinforcing rods.

2. Related Art

Such a reinforcing rod holder is known, for example, from CH-A-627 811, wherein its hollow body is formed from a front portion and a cover portion, and this holder is mainly produced from plastics material. In the last few years, the use of industrially manufactured reinforcing rod holders which have already been equipped with before leaving the factory has increased very considerably, and a large number of extremely varied reinforcing rod holders have been designed and used. During the course of ever wider applications and ever greater attempts at rationalisation, it has become apparent that ever greater significance is attributed to the thorough and rapid removal of the holder or portions thereof. This was initially taken into consideration, on the one hand, by replacing the reinforcing rod holders, which were originally formed only from expanded plastics material, by hollow bodies formed from plastics material, thereby substantially facilitating removal. However, the bodies formed from plastics material may break during removal and thereby involve additional work. On the other hand, there are reinforcing rod holders which are formed from metal or expanded metal and which remain in the wall after being embedded in concrete, so that it is only necessary to remove portions thereof, generally the cover portion. Reinforcing rod holders which are substantially formed only from metal are relatively expensive and, in addition, an increasing number of countries are inclined to issue regulations whereby metal portions have to be covered with a layer of concrete of specified thickness, for example 25 mm.

OBJECTS AND SUMMARY OF THE INVENTION

It is an object of the present invention to provide a reinforcing rod holder which is lightweight in respect of its component parts, is transportable, and can be rapidly and easily assembled, the free ends of the reinforcing rods being well secured in the holder and being well protected from the possibility of liquid cement penetrating therein. It is another object of the present invention to provide a holder which is easily removed, especially when compared with holders formed from plastics material or expanded material. It is yet another object of the invention to provide a reinforcing rod holder which is more; economical than known metal holders both in terms of manufacture and in respect of the portion remaining in the erected wall.

According to the invention the reinforcing rod holder comprises a hollow body in which may be disposed the free, bent ends of reinforcing rods, wherein the hollow body is formed from a box-shaped portion and a cover portion which comprises a metal plate and for facing a concrete wall to be erected, the cover portion being adapted to remain in the erected concrete wall.

BRIEF DESCRIPTION OF THE DRAWINGS

The invention is explained more fully hereinafter with reference to the following drawings.

FIG. 4 is a sectional view taken along the line IV—IV of FIG. 1.

FIG. 5 is a sectional view taken along the line V—V of FIG. 1.

FIG. 6 is an enlarged view of a modified embodiment of the cover portion.

DETAILED DESCRIPTION OF THE PREFERRED EMBODIMENTS

The first embodiment of a reinforcing rod holder includes a box 1, which is formed from plastics material, and a cover portion 2 at the wall end which is formed from metal and remains in the wall after the reinforcing rod holder has been embedded in concrete. The cover portion remaining in the erected wall 55 is formed from only one plate which, on the one hand, is relatively simple to manufacture and, on the other hand, has smaller dimensions than hitherto-known portions of reinforcing holders which are formed from metal and are intended to remain in the erected wall.

Figures 1, 2, 3:
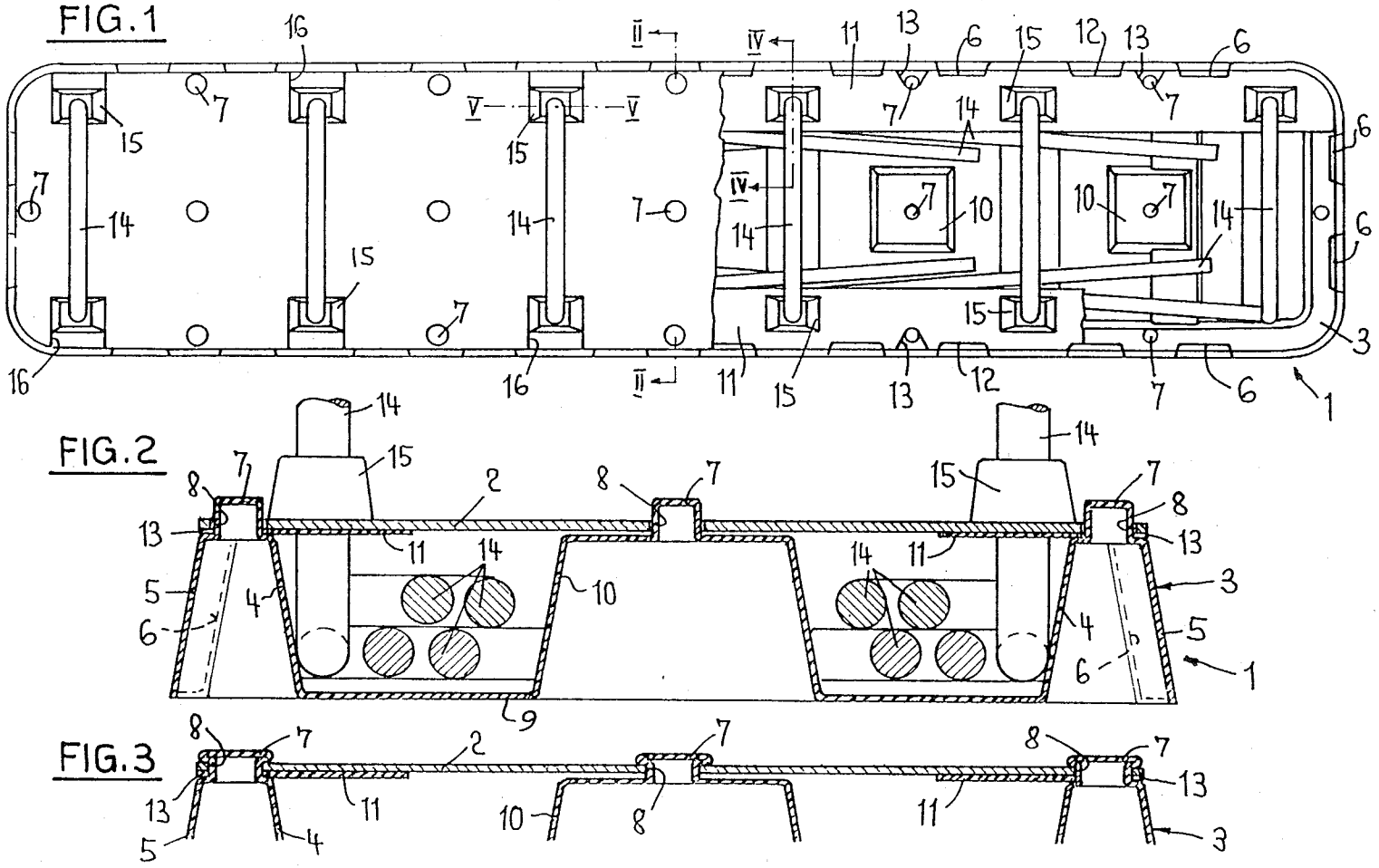
FIG. 1 is a plan view, from above, of a first embodiment of a reinforcing rod holder according to the invention, part of which is shown without the cover portion.
FIG. 2 is a sectional view taken along the line II—II of FIG. 1.
FIG. 3 shows a detail of FIG. 2 after the cover portion has been fitted.
Figure 13:
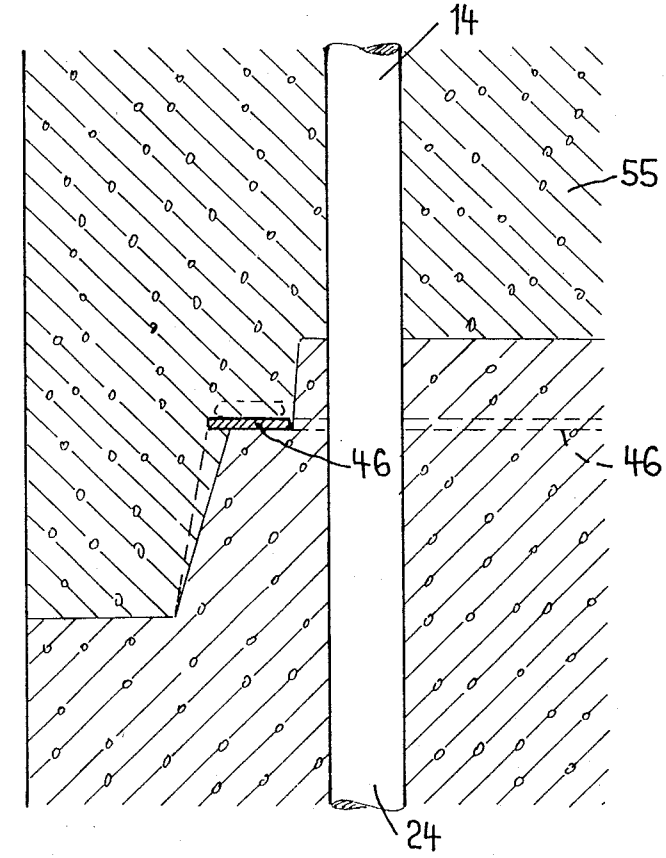
FIG. 13 illustrates a reinforcing rod with the remaining cover portion after being embedded in concrete.

As shown in FIG. 2, the box 1 is provided with a circumferential, double, U-shaped edge 3 having an inner wall 4 and an outer wall 5. The outer wall 5 has indentations 6 which are distributed around the entire outer wall. When the reinforcing rod holder is embedded in concrete, these indentations 6 cause concrete to pass behind the cover portion plate 2 which is to remain behind, so that this plate is securely joined to the wall and cannot become loosened, even when the rods are straightened and the plastics portion of the holder is removed. Pins 7 are provided on the upper surface of the circumferential edge and, as can be seen from FIG. 2. Pins 7 extend through corresponding openings 8 in the cover portion and are compressed, by means of a suitable device in such a manner that they press and secure the cover portion onto the box, as shown in FIG. 3. Raised portions 10, which are disposed in the centre of the box base 9 and protrude therefrom, serve the same purpose, and they also have pins 7 which fit into the corresponding openings 8 in the cover portion and are compressed. Each of the edges on the longitudinal sides is provided with a cover bar 11 which has, on its outer surface, recesses 12 which correspond to the indentations 6 and recesses 13 for exposing the pins 7. At the locations where the reinforcing rods 14 protrude from the box and cover portion, sockets 15 are provided in the cover bar 11 and extend through corresponding openings 16 in the cover portion. The sockets 15 taper upwardly and have, at their upper end, a hole 17 through which reinforcing rods are inserted. To permit the reinforcing rod to be inserted into the sockets, the inwardly oriented portion 18 of the cover bar and the inner surface of the socket 15 have a slot 19, as can be seen from FIG. 4. Instead of being extruded from plastics material as three component parts, the box and the two cover bars and the sockets can be extruded from plastics material in one piece. To permit insertion of the rods, in this case, it is necessary for the entire box to be supported around its longitudinal central axis. The reinforcing rods 14 are bent in a conventional manner so that the free ends converge with respect to the longitudinal central axis of the box. As can be seen from FIG. 5, in particular, the sockets permit the entire rounded portion, i.e. the transitional area between the clamp portion and the free ends of the reinforcing rod, to be situated within the holder. This arrangement ensures that the reinforcing rod can be fully straightened after removal of the plastics box and the sockets, as shown in FIG. 13.

As already mentioned above, the cover portion 2 is formed from metal. Because the cover portion remains in the wall, it is advantageous to establish the best possible joint between this metal portion and the wall. For this reason, it is desirable to provide the cover portion with a rough surface; this may be effected, for example, while the cover portion is being produced from expanded metal or, as shown in FIG. 6, by providing the cover portion with stamped and relatively sharp-edged raised portions 20. Other steps may also be taken, however, to increase the roughness of the cover portion 2 surface.

In certain countries, there are regulations stipulating that unprotected metal, i.e. metal which is not rust-proof, must be covered with a minimum layer of concrete, for example, 25 mm. This necessarily requires that the metal plate must have the prescribed minimum spacing from one edge. To permit the metal plate to be moved closer to the edge, it is extremely desirable with such regulations to protect the metal either by applying a layer of plastics material or by spraying with other resistant materials, for example, by means of electrostatic powder coating or the like. It is clear, therefore, that only the outer edge of the cover portion needs to be coated and not the entire metal plate.

In the described example, the box 1 is formed from a film of plastics material with a double, U-shaped edge. The plastics material may be replaced by another material; thus, for example, a strong cardboard may also be used, and it is not necessary for the edge to be formed from two walls which are joined together in a U-shaped manner. It is also possible for the connection between the box portion and the cover portion to be effected in a manner other than by means of expanding pins. It is also possible, for example, to join the two portions together by means of spot-welding or glueing, or to use other suitable securing means. In this embodiment, it may also prove appropriate to construct the metal plate in a multi-component manner so that, for example, it may be divided along the central axis.

Figure 7:
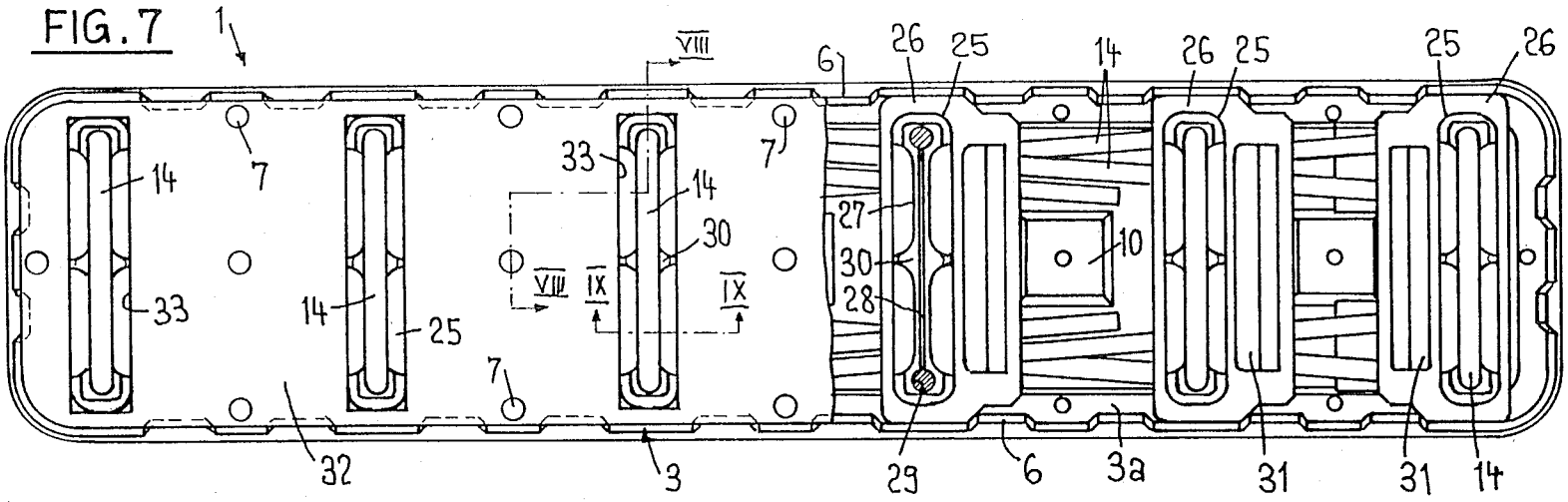
FIG. 7 is a plan view, from above, of a second embodiment of a reinforcing rod holder, part of which is shown without the cover portion.
Figure 9:
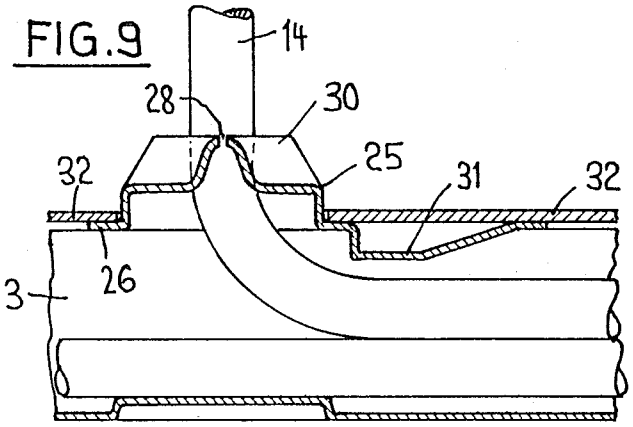
FIG. 9 is a sectional view taken along the line IX—IX of FIG. 7.
Figure 8:
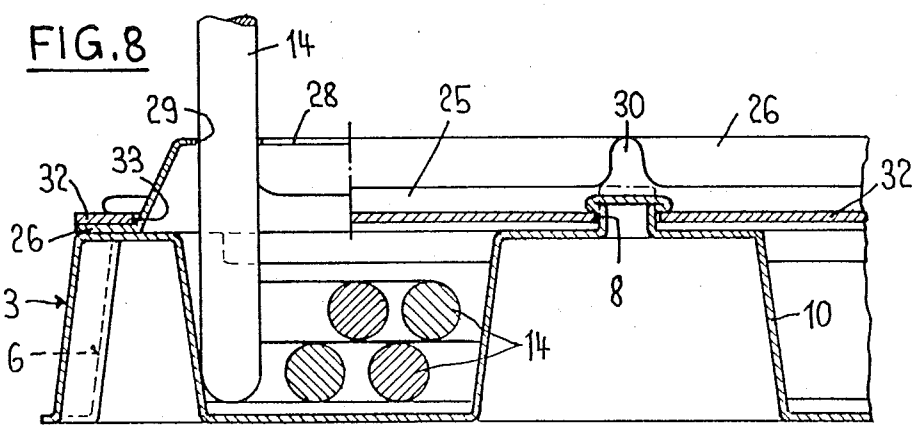
FIG. 8 is a sectional view, taken along the line VIII—VIII of FIG. 7, of a modified embodiment of the cover portion.

FIGS. 7 to 9 illustrate a second embodiment of a reinforcing rod holder, whereby both the manufacture and the assembly of the reinforcing rod holder are an improvement over the first embodiment. Box 1 is the same as described above, but the cover bars on the longitudinal sides are missing and the cover portion has different cut-away portions. Instead of having the cover bars on the longitudinal sides, the reinforcing rods 14 are supported by transversely disposed rod retainers 25 which also prevent liquid cement from penetrating therein. The rod retainers 25 which are also formed from plastics material, have a length which corresponds to the width of the box 1 and a cross-section, which is shown in FIG. 9, i.e. having a box-shaped form with a wide, circumferential edge 26, whereby the two side edges come to lie on the longitudinal sides of the box 1, and the cover portion is supported on all four circumferential edges. The upper portion of the rod retainer 25 converges in the centre to form a rib 27 which has a longitudinal central slot 28 extending to the openings 29 which are disposed at each end and through which the two shanks of the reinforcing rod 14 engage. The rib may have a reinforced portion 30 in the centre. On one side, the support member is connected to a hold-down member 31 which, as the name suggests, serves to hold-down the reinforcing rods.

For the assembly of the reinforcing rod holder, the rods 14 are first inserted into the box 1 with the bent shank ends which converge towards the centre. Markings may be applied to the rods prior to insertion in order; to determine the spacings between the rods 14. The rod retainers 25 are then passed over the clamps and pressed-down, whereupon the cover plate 32 is mounted thereon. The cover plate 32, in addition to having the above-described holes 8 for the pins 7, is provided with transversely extending slots 33 which are disposed according to the desired spacings between the reinforcing rods 14. As stated above, the pins 7 are subsequently pressed-down, either by means of a hammer, by compressed air or by a suitable device, and consequently the cover plate is secured to the box. As the cover plate 32 is pressed-down, it also presses upon the circumferential edge 26 of the rod holder whereby, on the one hand, the rod 14 holder acts on the shank ends of the reinforcing rod together with the hold-down member 31 and, on the other hand, causes the slot 28 in the rod holder to be compressed, whereby liquid cement is effectively prevented from penetrating therein. In a modified arrangement, the two longitudinal sides 3a of the box 1 may have recesses in which the two transverse edges of the rod retainer engage in order to permit the insertion of these edges at predetermined locations. As can be seen from FIG. 9, in particular, the use of rod holders having a central rib ensures that the entire curvature of the reinforcing rods is situated inside the holder, thereby ensuring complete straightening after they have been embedded in concrete.

Figure 10:
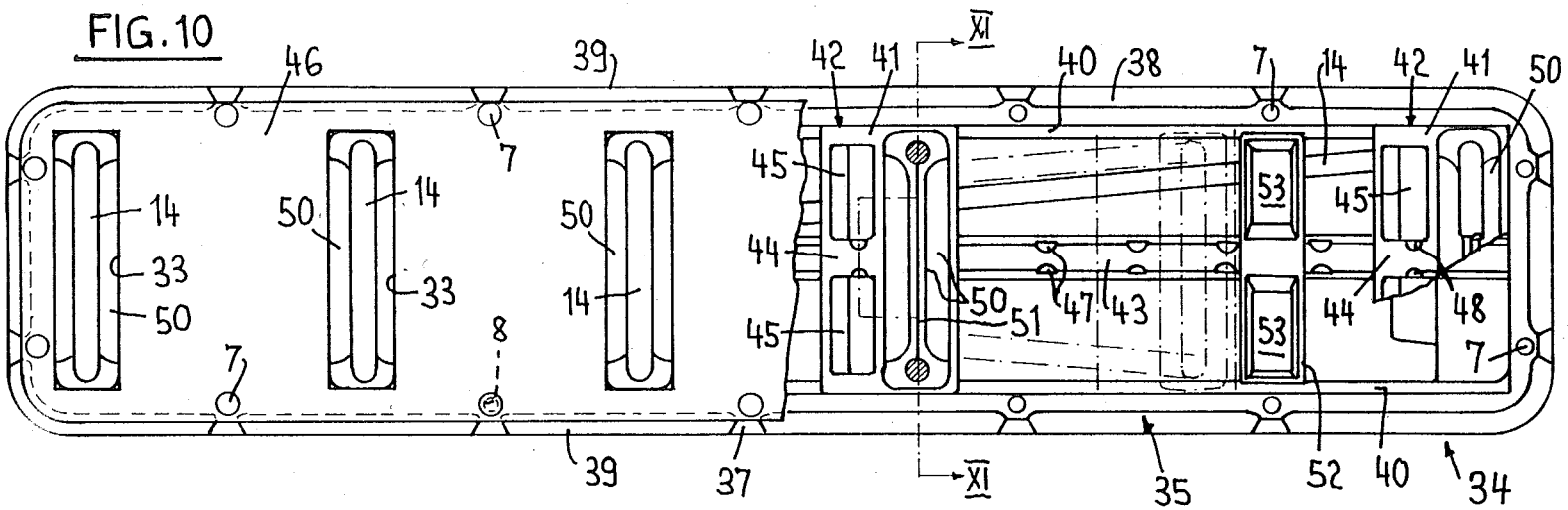
FIG. 10 is a plan view, from above, of a third embodiment of a reinforcing rod holder, part of which is shown without the cover portion.
Figure 11:
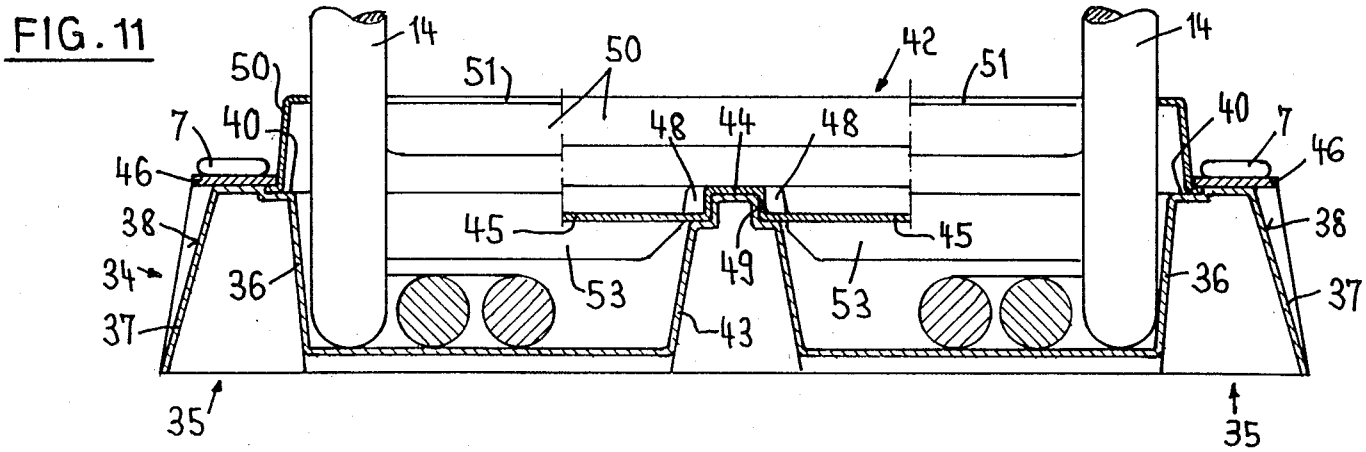
FIG. 11 is a sectional view taken along the line XI—XI of FIG. 10.

FIGS. 10 and 11 illustrate another embodiment of a reinforcing rod holder which, compared with the preceding example, provides further simplification both in the manufacture and in the assembly. Here also, the box 34 has a circumferential, double, U-shaped edge 35 with an inner wall 36 and an outer wall 37. The indentations 38 here are substantially longer than those in the two preceding examples, with the result that more concrete can pass behind the cover plate for better securement thereof. At the top end of each of the two longitudinal sides 39 of the inner edge 36, there is a shoulder portion 40 on which the edges 41 of the transverse sides of the rod retainers 42 are supported, such edges 41 being correspondingly shorter than those described in the preceding embodiment. The box also has a longitudinally central rib 43, which is raised from the base to substantially the same height as the perimetric edge 35. The hold-down member 44 of the rod holder is provided with recesses 45 which are disposed on both sides of the longitudinally central rib 43 and serve as guide means. To permit the reinforcing rods to be accurately aligned before the cover plate 46 is deposited, it is preferable to provide means for aligning the rod retainers 42. Such means may be, for example, small recesses 47 which are provided on the sides of the longitudinally central rib and in which corresponding cams 48 engage, such cams being disposed at the guiding ends 49 - facing the longitudinally central rib 43 - of the recesses 45 in the hold-down member 44. However, other marking means may also be provided; for example, small pins may be provided on the upper edge of the longitudinally central rib 43, such pins engaging in holes in the hold-down member 44, or vice versa. In order to ensure an approximate alignment of the reinforcing rods during their insertion into the box, corresponding markings may be provided on the longitudinal edges of the box. The cover plate 46 is of a design similar to that of the preceding example, but here the pins 7 are only disposed on the circumferential edge and engage in corresponding openings 8. However, it is also possible to provide pins on the longitudinally central rib 43, such pins engaging through corresponding openings in the cover portion. The rib 50 in the rod holder does not have any reinforcement in the centre and is particularly well-suited to forming a tight seal, since it has been shown that, when a pressure is exerted upon the edges 41 which are disposed on both sides of the rib 43, the two edges of the slot 51 in the rib 43 are pressed towards each other.

For the purpose of securing the rods in the holder, it is advantageous to use holder inserts 52 which are also supported on the two shoulder portions 40 of the longitudinal edges and have recesses 53 disposed on both sides of the longitudinally central rib 43.

The component parts can be stacked one inside the other or one above the other in order to minimize space during transportation.

The assembly for this last-described rod holder is very simple. First of all, the reinforcing rods 14 are inserted at previously designated locations; the rod retainers 42 are mounted at the marked locations and the holder inserts are placed thereon; subsequently the cover plate 46 is mounted and then the pins 7 are compressed by means of a hammer or a suitable device in order to secure the cover plate 46. It is apparent from the description, especially from the last two examples, that it is not necessary for any tools to be used for the assembly of this reinforcing rod holder except a hammer or, for a rational assembly, a pneumatically driven press, and the assembly is conceptually simple.

However, the reinforcing rod holder offers substantial advantages not only in terms of its manufacture and assembly, but also in terms of its securement and in terms of erecting the connecting wall. By providing the rod retainers 42 with the raised rib 50, or 27 in the preceding example, the second wall is provided with a tooth-like arrangement relative to the first wall and increases the securement.

Figure 12:
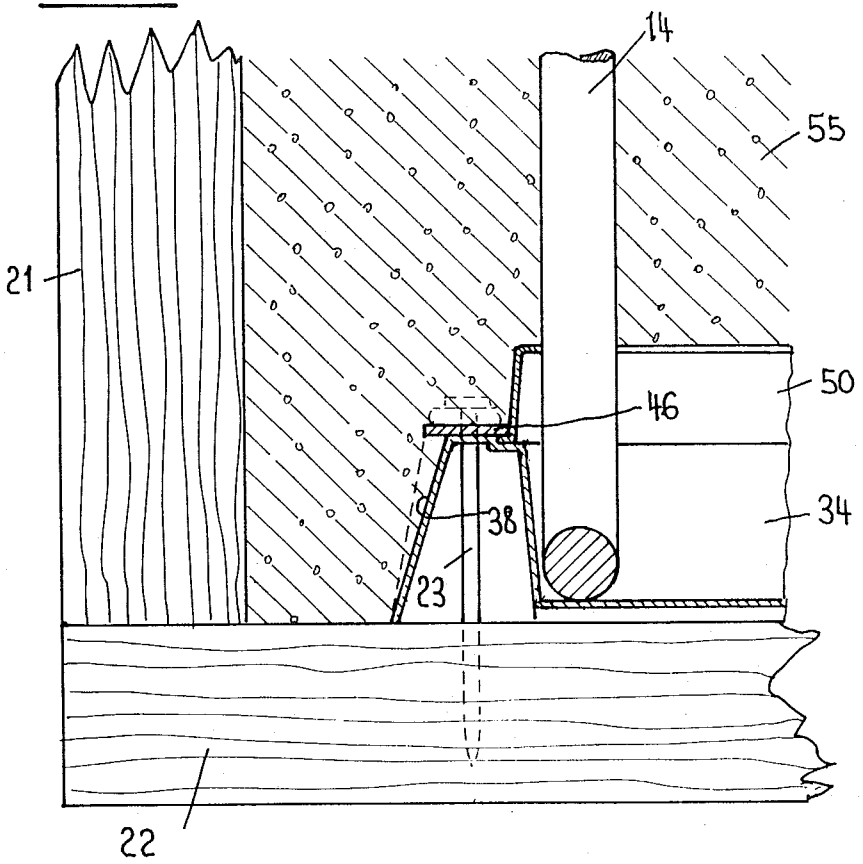
FIG. 12 is a sectional view of the reinforcing rod holder shown in FIG. 1, prior to its being embedded in concrete.

FIG. 12 is a sectional view of a portion of a secured reinforcing rod holder. The two casing boards 21 and 22 are visible, and it can be seen that the reinforcing rod holder is secured in the casing board 22 by means of nails 23. Nailing the reinforcing rod holder is considerably simplified in that the nails can be hit through the opening 8 and, above all, through the pins 7, with the result that the suitable locations can very easily be discovered, whereby the nails are partially guided. After the rod holder has been embedded in concrete, the free ends 24 of the reinforcing rod are straightened (see FIG. 13), and subsequently the box is easily removed. If necessary, the cover bars 11 are also removed. As already mentioned above, because concrete engages behind the cover plate 32, 2 or 46, the plate remains is firmly anchored in the wall and is not loosened either when the reinforcing rod is straightened or when the box portion is pulled away.

In the two last-described embodiments also, the box is preferably formed from a plastics film, but it is also possible here to use instead a different material, cardboard for example. The material of the cover plates 32 or 46 is the same as that of the cover plate 2 in the first example and may comprise expanded metal or a metal plate with a roughened surface. In addition, the base of the box 1 or 34 has bearing and guide surfaces to ensure that the reinforcing rods are securely held-down.

The three reinforcing rod holders, which are described above and illustrated, relate to reinforcing rods provided with a clamp and two free shanks, but it is possible to provide a suitably modified reinforcing rod holder for reinforcing rods which have only one shank and an open clamp. Thus, the width of the reinforcing rod will be only approximately half that of the reinforcing rod, as shown in FIG. 10 for example, and the other longitudinal wall which has the same shoulder portion 40 is disposed at the location of the longitudinally central rib 43. The rod retainers and the holder inserts are then suitably shaped, i.e. the rod retainers have an opening in the centre and a suitably shaped hold-down member, whereas the holder inserts have only one recess. Here also, the reinforcing rods can first of all be inserted, and then the rod retainers and the insert parts are deposited or placed, whereupon the cover plate can be mounted and is secured by means of the pins which extend through corresponding openings.

I claim:

1. A reinforcing rod holder for use in joining cast concrete work comprising:

a box-shaped body adapted to receive free ends of reinforcing rods;

a cover means removably secured to said body, for substantially enclosing said body; and an embedding means for embedding said cover means in a concrete mass, apart from said body, while said cover means is removably secured to said body, said embedding means comprising a recess means formed in said box-shaped body for permitting concrete to pass behind said cover means when the holder is embedded in concrete.

2. A reinforcing rod holder according to claim 1, further comprising securing means disposed on said body and on said cover means for removably securing said cover means to said body.

3. A reinforcing rod holder according to claim 2, wherein said securing means comprises securing holes disposed around a perimeter of said cover means and pin means disposed on said body in positions congruent with said securing holes, for removably securing said cover means to said body.

4. A reinforcing rod holder according to claim 1, wherein said box-shaped body comprises a bottom wall and a perimeter wall, said perimeter wall being comprised of an inner wall and an outer wall joined together at upper surfaces thereof; and wherein said recess means comprise indentations formed in said outer wall.

5. A reinforcing rod holder for use in joining cast concrete work comprising:

a box-shaped body adapted to receive free ends of reinforcing rods, said body comprising a pair of shoulder portions disposed along parallel interior edges thereof and displaced from each other by a displacement distance a cover means removably secured to said body for substantially enclosing said body;

an embedding means for embedding said cover means in a concrete mass, apart from said body, while said cover means is removably secured to said body; and at least one rod retainer having a length substantially corresponding to said displacement distance and having a perimetric edge;

wherein said perimetric edge of each rod retainer rests atop said pair of shoulder portions.

6. A reinforcing rod holder according to claim 5, wherein at least a perimeter of said cover means is provided with a protective layer.

7. A reinforcing rod holder according to claim 6, wherein said protective layer is comprised of a material selected from the group consisting of plastics material and electrostatically coated covering.

8. A reinforcing rod holder according to claim 5, wherein said cover means comprises sharp-edged raised means for increasing the roughness of the cover means surface.

9. A reinforcing rod holder according to claim 5, wherein said cover means has openings disposed at locations corresponding to said rod retainers.

10. A reinforcing rod holder according to claim 5, wherein said rod retainers are each provided with a first pair of openings for receiving reinforcing rods and said cover means is provided with second pairs of openings for receiving reinforcing rods; and wherein said cover means is disposed above said rod retainers, said first pairs of openings being aligned with said second pairs of openings.

11. A reinforcing rod holder according to claim 10, wherein each of said rod retainers comprise:

a raised rib which abuts said first pair of openings;

a longitudinal slot disposed in said raised rib; and a hold-down means, disposed at a first end of said rod retainer, for holding a reinforcing rod down inside said body.

12. A reinforcing rod holder according to claim 11, further comprising:

raised portions disposed along a central axis of said body;

a securing pin disposed on each raised portion; and wherein said cover means is provided with a set of third openings congruent with said raised portions, whereby said securing pins extend through said third openings in the cover means.

13. A reinforcing rod holder according to claim 5 further comprising:

a body rib disposed along a longitudinal extent of said body; and a positioning means for positioning reinforcing rods within said body.

14. A reinforcing rod holder according to claim 13, further comprising aligning means for aligning said rod retainers, said aligning means comprising:

retaining means disposed on the shoulder portions of said body for securing said rod retainers; and a pair of aligning recesses disposed on either side of said body rib for aligning said rod retainers.

15. A reinforcing rod holder according to claim 13, wherein said positioning means comprises:

a hold down means for holding down reinforcing rods within said body, said hold down means being disposed transversely to said body rib and having a recess on either side of said body rib.

16. A reinforcing rod holder according to claim 5, wherein said shoulder portions comprise recess means for receiving and aligning said rod retainers.

17. A reinforcing rod holder for use in joining cast concrete work comprising:

a box-shaped body adapted to receive free ends of reinforcing rods, said body comprising a bottom wall and a perimeter wall, said perimeter wall being comprised of an inner wall and an outer wall joined together at upper surfaces thereof, a cover means removably secured to said body, for substantially enclosing said body;

an embedding means for embedding said cover means in a concrete mass, apart from said body, while said cover means is removably secured to said body, said embedding means comprising indentations formed in said outer wall for permitting entry of concrete;

a pair of cover bars disposed along parallel longitudinal edges of said inner wall, said cover bars having a plurality of receiving recesses for receiving reinforcing rods; and socket means, disposed on said cover bars around said receiving recesses, for retaining reinforcing rods; and wherein said cover means further comprises openings through which said socket means protrude.

18. A reinforcing rod holder according to claim 17, wherein said body, said cover bars, and said socket means are integrally formed from plastics material.

19. A reinforcing rod holder according to claim 18, wherein said body has raised portions along a central axis thereof; and wherein a securing pin is disposed on each of said raised portions and extends through a congruent opening in said cover means.

20. A reinforcing rod holder according to claim 17, wherein said socket means are frusto-conically shaped and comprise a slot means disposed along an inner surface thereof.

21. A reinforcing rod holder for use in joining cast concrete work comprising:

a box-shaped body adapted to receive free ends of reinforcing rods, said body comprising a pair of shoulder portions disposed along parallel interior edges thereof and displaced from each other by a displacement distance;

a cover means removably secured to said body for substantially enclosing said body;

an embedding means for embedding said cover means in a concrete mass, apart from said body, while said cover means is removably secured to said body; and at least one rod retainer having a length substantially corresponding to said displacement distance and having a perimetric edge;

wherein said perimetric edge of each rod retainer rests atop said pair of shoulder portions

* * * * *